US007043150B2

(12) United States Patent
Krause et al.

(10) Patent No.: US 7,043,150 B2
(45) Date of Patent: May 9, 2006

(54) METHODS AND APPARATUS FOR WATER DELIVERY SYSTEMS WITHIN REFRIGERATORS

(75) Inventors: Andrew Reinhard Krause, LaGrange, KY (US); Adam Paul Banet, Floyds Knobs, IN (US); James Christopher Roberts, Louisville, KY (US)

(73) Assignee: General Electric Company, Schenectady, NY (US)

( * ) Notice: Subject to any disclaimer, the term of this patent is extended or adjusted under 35 U.S.C. 154(b) by 100 days.

(21) Appl. No.: 10/640,198

(22) Filed: Aug. 13, 2003

(65) Prior Publication Data

US 2005/0036772 A1 Feb. 17, 2005

(51) Int. Cl.
*A47J 31/00* (2006.01)

(52) U.S. Cl. ..... 392/465; 222/146.1

(58) Field of Classification Search ..... 392/465–485; 222/1, 146.1, 146.2

See application file for complete search history.

(56) References Cited

U.S. PATENT DOCUMENTS

| | | | | |
|---|---|---|---|---|
| 3,914,957 | A | 10/1975 | Jacobs | |
| 5,127,236 | A | 7/1992 | von Blanquet | |
| 5,195,655 | A * | 3/1993 | Bukhman | 222/1 |
| 5,315,845 | A | 5/1994 | Lee | |
| 5,490,547 | A | 2/1996 | Abadi et al. | |
| 5,542,264 | A | 8/1996 | Hortin et al. | |
| 5,889,684 | A | 3/1999 | Ben-David et al. | |
| 5,907,958 | A * | 6/1999 | Coates et al. | 62/338 |
| 2002/0083726 | A1 | 7/2002 | Kim et al. | |

* cited by examiner

*Primary Examiner*—Thor S. Campbell
(74) *Attorney, Agent, or Firm*—George L. Rideout; Armstrong Teasdale LLP

(57) ABSTRACT

A fluid dispensing system is provided. The fluid dispensing system includes a fluid storage tank, a filter in flow communication with the fluid storage tank and a heating device proximate to at least one of the fluid storage tank and the filter.

23 Claims, 3 Drawing Sheets

METHODS AND APPARATUS FOR WATER DELIVERY SYSTEMS WITHIN REFRIGERATORS

BACKGROUND OF THE INVENTION

This invention relates generally to refrigerators, and more particularly, to water dispensing systems for refrigerators.

Refrigerators typically include water storage tanks for cooling and storage of water to be dispensed. In one type of dispensing system, a serpentine water storage tank is employed with a water filter. See, for example, U.S. Pat. No. 3,511,415. Further, some dispensing systems include a water filter adjacent to a water storage tank located in a fresh food or freezer food compartment of the refrigerator.

Modern refrigerators, for example, typically include a compressor, an evaporator, and a condenser in a closed refrigeration circuit, and a number of fans and dampers that facilitate the refrigeration circuit and direct cooled air into refrigeration compartments. Collectively, these components perform the basic cooling functions of the refrigerator. Additionally, refrigerators typically include a number of auxiliary and peripheral devices, including auxiliary fans, icemakers, dispensing devices for ice and water, and defrost units that perform ancillary functions beyond the basic cooling requirements of the refrigerator. In some refrigerators, separate temperature controlled storage compartments or drawers include fans, dampers, and controls for quick chilling or long term storage at temperatures independent of the main refrigeration compartments. Still further, a plurality of lighting components, displays, and audio indicators may be associated with the foregoing basic or ancillary features and components. Water dispensing systems inside refrigerated cabinets are sometimes subjected to temperature environments that can cause a water dispensing system to freeze.

BRIEF DESCRIPTION OF THE INVENTION

In one aspect, a fluid dispensing system is provided. The fluid dispensing system includes a fluid storage tank, a filter in flow communication with the fluid storage tank and a heating device proximate to at least one of the fluid storage tank and the filter.

In another aspect, a modular water dispensing system for a refrigerator is provided. The modular water dispensing system includes an outer shell having a first half and a second half defining an inner surface and an outer surface, a coil disposed within the outer shell, a filter disposed within the outer shell and in flow communication with the coil, a heat transfer medium disposed between the inner surface and at least one of the coil and the filter, and a heating element coupled to the heat transfer medium.

DETAILED DESCRIPTION OF THE INVENTION

Figure 1:
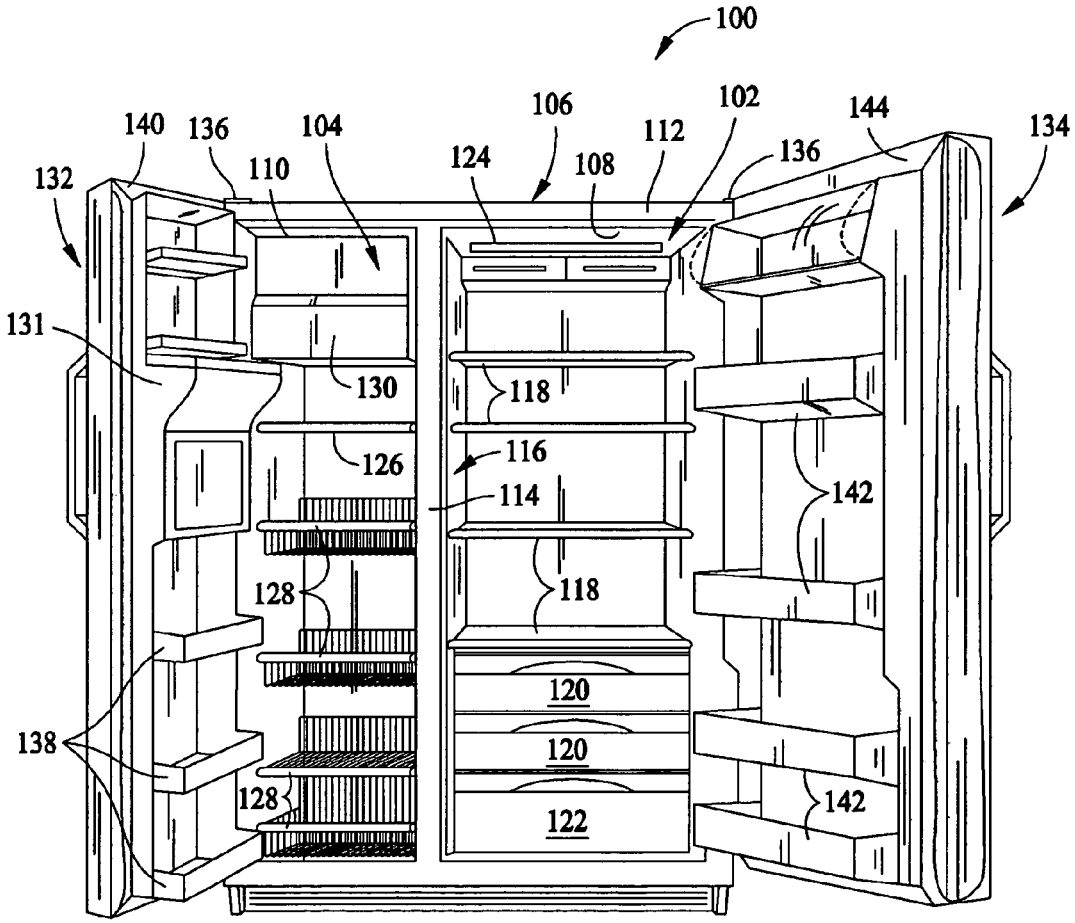
FIG. 1 is a perspective view of an exemplary refrigerator.

FIG. 1 is a perspective view of an exemplary refrigerator 100 in which exemplary embodiments of the present invention may be practiced and for which the benefits of the invention may be realized. It is appreciated, however, that the herein described methods and apparatus may likewise be practiced in a variety of alternative refrigerators with modification apparent to those in the art. Therefore, refrigerator 100 as described and illustrated herein is for illustrative purposes only and is not intended to limit the herein described methods and apparatus in any aspect.

FIG. 1 illustrates a side-by-side refrigerator 100 including a fresh food storage compartment 102 and a freezer storage compartment 104. Freezer compartment 104 and fresh food compartment 102 are arranged side-by-side. In one embodiment, refrigerator 100 is a commercially available refrigerator from General Electric Company, Appliance Park, Louisville, Ky. 40225, and is modified to incorporate the herein described methods and apparatus.

It is contemplated, however, that the teaching of the description set forth below is applicable to other types of refrigeration appliances, including but not limited to top and bottom mount refrigerators wherein undesirable temperature gradients may exist. The herein described methods and apparatus is therefore not intended to be limited to any particular type or configuration of a refrigerator, such as refrigerator 100.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 may partly form a quick chill and thaw system (not shown) and selectively controlled, together with other refrigerator features, by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104.

Microprocessor is programmed to perform functions described herein, and as used herein, the term microprocessor is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

Freezer compartment 104 includes an automatic ice maker 130 and a dispenser 131 is provided in freezer door 132 so that ice can be obtained without opening freezer door 132. As will become evident below, ice maker 130, in accordance with conventional ice makers includes a number of electromechanical elements that manipulate a mold to shape ice as it freezes, a mechanism to remove or release frozen ice from the mold, and a primary ice bucket for storage of ice produced in the mold. Periodically, the ice supply is replenished by ice maker 130 as ice is removed from the primary ice bucket. The storage capacity of the primary ice bucket is generally sufficient for normal use of refrigerator 100.

Freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 2:
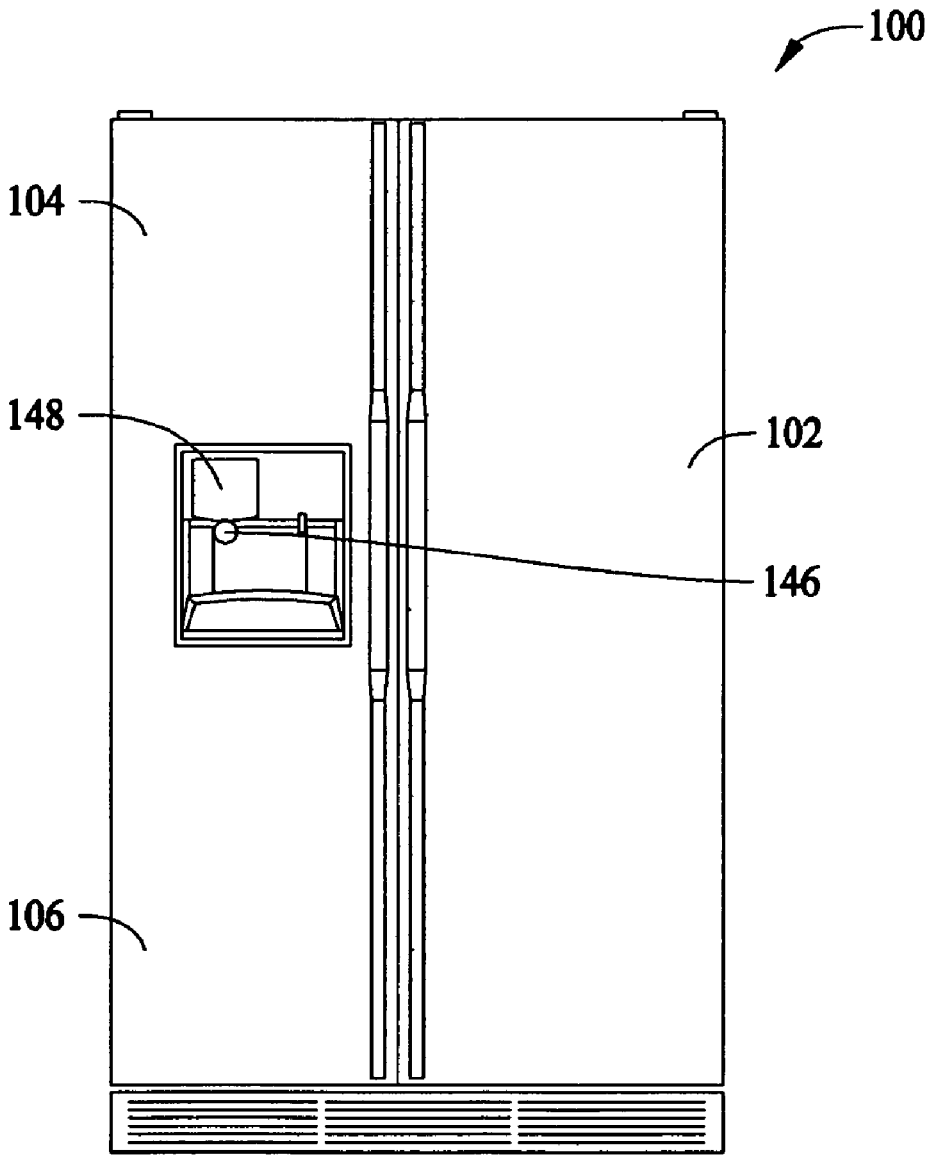
FIG. 2 is a front view of an exemplary ice dispensing apparatus.

FIG. 2 is a front view of refrigerator 100 with doors 102 and 104 in a closed position. Freezer door 104 includes a through the door water dispenser 146, and a user interface 148.

Figure 3:
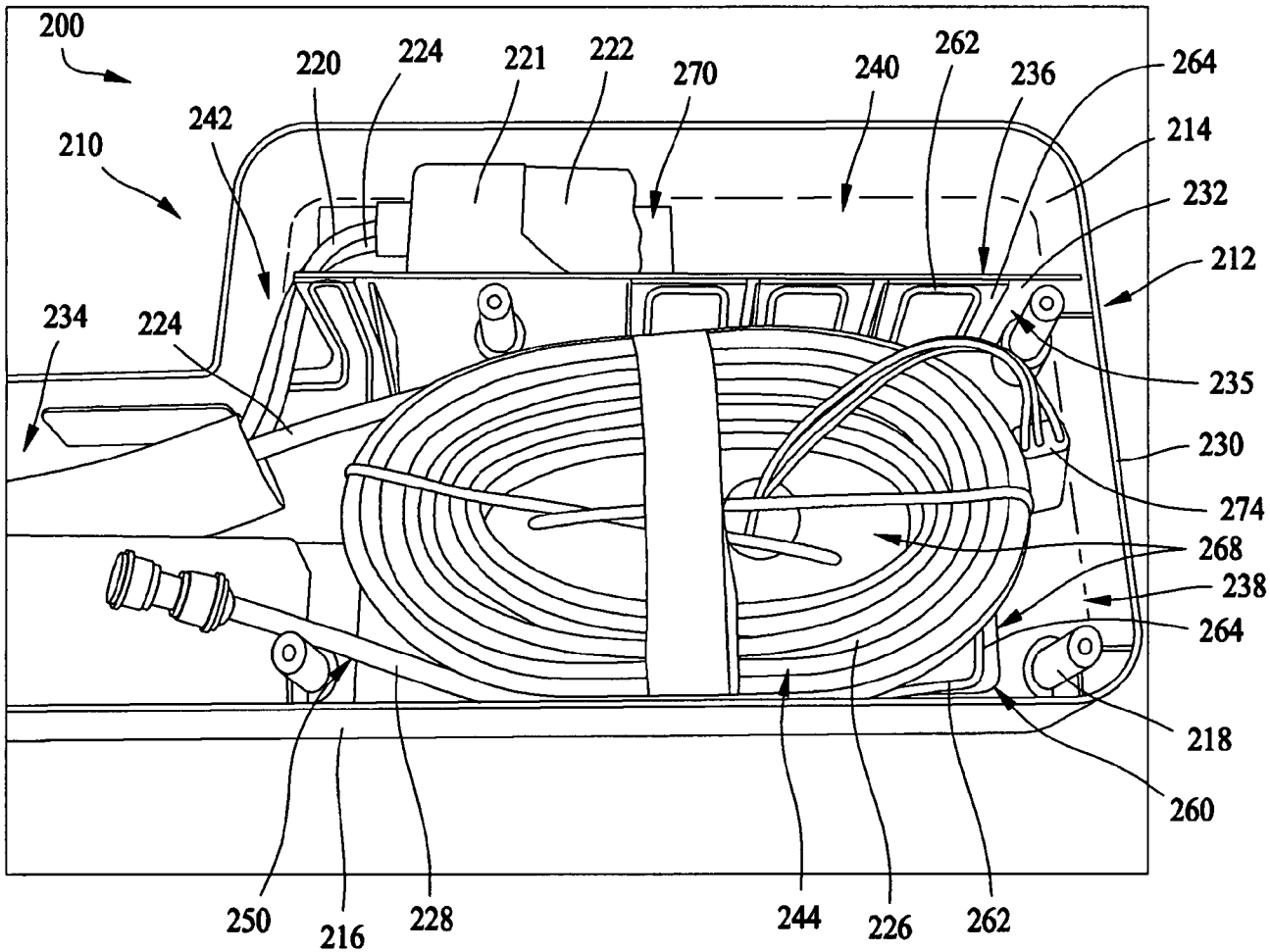
FIG. 3 is a perspective view of an exemplary water dispensing system.

FIG. 3 is a perspective view of a water dispensing system 200. Water dispensing system 200 has an outer shell 210 including a first half 212 and a second half, such as a cover (not shown). First half 212 and cover define an inner surface 214 and an outer surface 216. In one embodiment, the cover is releasably removable from first half 212. In another embodiment, first half 212 has at least one mounting member 218 for receiving fasteners which extend from inner surface 214 for mounting to a surface.

Water dispensing system 200 includes a fluid inlet line 220, a filter manifold 221, a filter 222, a fluid intermediate line 224, a fluid tank or coil 226, and a fluid outlet line 228 extending from coil 226. First half 212 has sidewalls 230 and a partition 232 extending from inner surface 214. Sidewalls 230 of first half 212 form a channel 234 at one end of first half 212 allowing inlet line 220 and intermediate line 224 to extend into outer shell 210. Partition 232 has a first side 235 which faces coil 226 and a second side 236 which faces filter 222. Partition 232 divides first half 212 into a coil portion 238 and a filter portion 240. In one embodiment, partition 232 and sidewall 230 are spaced apart to form a passage 242 between coil portion 238 and filter portion 240.

A fluid, such as water, is supplied to water dispensing system 200 by inlet line 220 from a water source (not shown). Inlet line 220 extends through channel 234 and is coupled to filter 222. Filter 222 is removably mounted to inner surface 214 of filter portion 240. Intermediate line 224 extends from filter 222 through channel 234 to a valve (not shown). The valve controls fluid flow between filter 222 and coil 226 through intermediate line 224. In one embodiment, the valve is actuated by user operation of water dispenser 146 using user interface 148. Intermediate line 224 extends from the valve back through channel 234 to be coupled to coil 226.

In the exemplary embodiment, coil 226 curves back and forth in a plurality of loops 244 to increase a length of its flow path between intermediate line 224 and outlet line 228 while conserving space. In one embodiment, coil 226 is serpentine shaped like an inverted "S", although other serpentine shapes could be used having a plurality of bends. Outlet line 228 extends from coil 226 and passes through an opening 250 in sidewall 230 of outer shell 210. In one embodiment, outlet line 228 is coupled to water dispenser 146.

Water dispensing system 200 receives unfiltered water entering through inlet line 220 from the water source. The unfiltered water passes through filter 222, whereby filtered water exits filter 222 to travel through intermediate line 224. Filtered water is cooled during its passage through coil 226 and ultimately discharged as cooled water through outlet line 228 to water dispenser 146 just prior to use.

Water dispensing systems are susceptible to freezing from being subjected to a cold environment. In one embodiment, water dispensing system 200 is positioned adjacent or proximate a heat source. In another embodiment, a heating device is adjacent or proximate to water dispensing system 200. In another embodiment, the heating device is any component of refrigerator 100, such as condenser tubing, that provides heat to water dispensing system 200. For example, heat would pass through outer shell 210. Outer shell 210 would capture and retain the heat keeping the airflow inside refrigerator 100 from cooling water dispensing system 200 to freezing.

In the exemplary embodiment, a heating device 260 is disposed within outer shell 210 of water dispensing system 200 to heat water dispensing system 200 and prevent the water from freezing. In addition, heating device 260 maintains filter 222 above freezing to prevent filter degradation. In one embodiment, heating device 260 is proximate to inlet line 220, filter 222, intermediate line 224, coil 226, or outlet line 228. In another embodiment, heating device 260 is in contact with inlet line 220, filter 222, intermediate line 224, coil 226, or outlet line 228. In an exemplary embodiment, heating device 260 includes a heating element, such as a resistance wire 262, coupled to a heat transfer medium, such as a foil 264, within outer shell 210. Foil 264 extends along inner surface 214 of either first half 212 or second half of outer shell 210. As shown in FIG. 3, a first foil pad 268 is disposed in coil portion 238 and a second foil pad 270 is disposed in filter portion 240. First and second foil pads 268 and 270 are disposed between inner surface 214 and at least one of inlet line 220, filter 222, intermediate line 224, coil 226, and outlet line 228. In one embodiment, first and second foil pads 268 and 270 are joined together through passage 242 to form a unitary foil pad. As shown in FIG. 3, partition 232 has foil 264 on first side 235 of partition 232. In one embodiment, partition 232 has foil 264 on second side 236 of partition 232. In another embodiment, partition 232 is a heat transfer medium allowing heat to pass between coil portion 238 and filter portion 240.

Resistance wire 262 is coupled to foil 264 and extends along an outer periphery of foil 264. In one embodiment, resistance wire 262 is coupled to foil 264 by an adhesive. In another embodiment, resistance wire 262 is integral to foil 264. In another embodiment, resistance wire 262 is weaved into foil 264. In another embodiment, resistance wire 262 forms a plurality of patterns across the surface area of foil 264. In one embodiment, a pattern of resistance wire 262 is configured to substantially match the shape of inlet line 220, filter 222, intermediate line 224, coil 226, or outlet line 228.

Resistance wire 262 is electrically coupled to a power source, such as a power source (not shown) of refrigerator 100. In one embodiment, heating device 260 may be operational in a constant state of operation such that, for example, resistance wire 262 is continuously energized to provide constant heat to foil 264. In another embodiment, control devices are utilized to limit the cycling of heating device 260. The controlled cycling of heating device 260 can be achieved by a switch, a thermostat, a thermal cutout device, an electronic control board, operating heating device 260 in conjunction with refrigerator system fans, operating heating device 260 in conjunction with the compressor, and utilizing timing devices. In the exemplary embodiment, a thermal cutout 274 is triggered at a point in which water dispensing system 200 is at risk of freezing. Thermal cutout 274 is in series with heating device 260 and actuates heating device 260. Thermal cutout 274 triggers again when an upper limit is reached to turn off heating device 260. The upper limit prevents the water temperature from reaching temperatures that would not supply chilled water. In one embodiment, a control device activates heating device 260 when a specified temperature has been reached and deactivates heating element 260 when another specified temperature has been reached. The specified temperatures may be programmed into the control device or may be inputted by a user. In another embodiment, resistance wire 262 is electrically coupled to the microprocessor of refrigerator 100 and is selectively switched on and off via control interface 124. In another embodiment, power to resistance wire 262 is selectively provided by activation of a mechanical switch, such as a cam on a control knob that triggers a switch at a point in which the water dispensing system 200 is at risk of freezing.

In one embodiment, water dispensing system 200 is modular and is mountable in a plurality of orientations inside or outside refrigerator 100. Thus, water dispensing system 200 is platform independent and is readily fitted to many different platforms. In other words, a first refrigerator (not shown) and a second refrigerator (not shown) sized different than the first refrigerator both have the same water dispensing system 200. In one embodiment, first refrigerator has a first capacity and second refrigerator has a second capacity such that the first capacity is sized different from the second capacity. In this way, water dispensing system 200 reduces manufacturing times with a subsystem that is prepackaged. In addition, water dispensing system reduces risk of freezing for platforms with large variability in temperature performance.

While the invention has been described in terms of various specific embodiments, those skilled in the art will recognize that the invention can be practiced with modification within the spirit and scope of the claims.

What is claimed is:

1. A fluid dispensing system comprising:

an outer shell, said outer shell defining a channel along a side wall thereof;

a fluid inlet line received in said channel;

a fluid storage tank disposed within said outer shell;

a filter coupled to said fluid inlet line;

an intermediate fluid line delivering fluid from an outlet of said filter to an inlet of said fluid storage tank; and a heating device proximate to at least one of said fluid storage tank and said filter.

2. A fluid dispensing system according to claim 1 wherein said heating device is in contact with at least one of said fluid storage tank and said filter.

3. A fluid dispensing system according to claim 1 wherein said heating device includes a heating element and a heat transfer medium.

4. A fluid dispensing system according to claim 3 wherein said heating element is a resistance wire.

5. A fluid dispensing system according to claim 3 wherein said heat transfer medium is a foil.

6. A fluid dispensing system according to claim 1 wherein said heating device is continuously operated.

7. A fluid dispensing system according to claim 1 wherein said heating device is configured to energize when a refrigerator fan is energized and de-energize when the refrigerator fan is de-energized.

8. A fluid dispensing system according to claim 1 wherein said heating device is activated at a specified temperature and deactivated at another specified temperature.

9. A water dispensing system for a refrigerator comprising:

an outer shell having a first half and a second half defining an inner surface and an outer surface;

a coil disposed within said outer shell;

a filter disposed within said outer shell and in flow communication with said coil;

a heat transfer medium disposed between said inner surface and at least one of said coil and said filter; and a heating element coupled to said heat transfer medium.

10. A water dispensing system according to claim 9 wherein said heating element is a resistance wire.

11. A water dispensing system according to claim 10 wherein said resistance wire is integral to said heat transfer medium.

12. A water dispensing system according to claim 10 wherein said resistance wire is positioned proximate to an outer periphery of said heat transfer medium.

13. A water dispensing system according to claim 10 wherein said resistance wire extends in a plurality of patterns across said heat transfer medium.

14. A water dispensing system according to claim 9 wherein said heat transfer medium is a foil and said heating element is configured to energize when a refrigerator compressor is energized and de-energize when the refrigerator compressor is de-energized.

15. A water dispensing system according to claim 14 wherein said foil extends substantially across said inner surface of at least one of said first and second halves.

16. A water dispensing system according to claim 9 wherein said heating element is configured to energize when a refrigerator fan is energized and de-energize when the refrigerator fan is de-energized.

17. A water dispensing system according to claim 9 wherein said heating element is controlled by a microprocessor.

18. A water dispensing system according to claim 9 wherein said heating element is activated by a control device.

19. A water dispensing system according to claim 9 further comprising a thermal cutout, said thermal cutout is configured to activate said heating element when at least one of said coil and said filter is at a specified temperature and deactivate said heating element when at least one of said coil and said filter is at another specified temperature.

20. A water dispensing system according to claim 9 further comprising an inlet line coupled to said filter for supplying water, an intermediate line having one end coupled to said filter and another end coupled to said coil, and an outlet line having one end coupled to said coil and another end in flow communication with a water dispenser.

21. A modular fluid dispensing system comprising:

an outer shell mountable to a surface, said outer shell defining a channel along a side wall thereof;

a fluid inlet line received in said channel;

a fluid storage tank disposed within said outer shell;

a filter coupled to said fluid inlet line;

an intermediate fluid line delivering fluid from an outlet of said filter to an inlet of said fluid storage tank; and a heating device proximate to at least one of said fluid storage tank and said filter.

22. A modular fluid dispensing system according to claim 21 wherein said heating device is configured to energize when a refrigerator compressor is energized and de-energize when the compressor is de-energized.

23. A modular fluid dispensing system according to claim 21 wherein said modular fluid dispensing system is configured to be coupled to a first refrigerator having a first refrigerator capacity and a second refrigerator having a second refrigerator capacity different from the first capacity.

* * * * *